US010166484B1

(12) United States Patent
Chen

(10) Patent No.: US 10,166,484 B1
(45) Date of Patent: Jan. 1, 2019

(54) BUCKET SPLASH DUMPER

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 0 days.

(21) Appl. No.: 15/969,082

(22) Filed: May 2, 2018

(30) Foreign Application Priority Data

Sep. 26, 2017 (CN) ..... 2017 2 1241734 U

(51) Int. Cl.
*E04H 4/14* (2006.01)
*A63G 31/00* (2006.01)
*E04H 4/00* (2006.01)

(52) U.S. Cl.
CPC ..... *A63G 31/007* (2013.01); *E04H 4/0025* (2013.01); *E04H 4/14* (2013.01)

(58) Field of Classification Search
CPC ..... A63G 31/00; A63G 31/007; A63B 9/00; A63B 69/18; A63H 33/00; A63H 33/30; E04H 4/0012; E04H 4/0037; E04H 4/14; E04H 4/025; A47K 3/325
USPC ..... 472/117, 128; 446/153; 4/488, 506–507, 4/509
See application file for complete search history.

(56) References Cited

U.S. PATENT DOCUMENTS 3,431,565 A * 3/1969 Nelson ..... A47K 3/325 4/598
4,773,104 A * 9/1988 Wang ..... A61H 33/6036 210/416.2
4,893,364 A * 1/1990 Keeler ..... E03C 1/00 137/393
5,815,853 A * 10/1998 Chase ..... E04H 4/0037 4/506
5,820,471 A * 10/1998 Briggs ..... A63B 9/00 472/128
5,820,472 A * 10/1998 Briggs ..... A63B 9/00 472/128
5,839,964 A * 11/1998 Rudell ..... A63B 9/00 472/117
6,050,872 A * 4/2000 Cahill ..... A63H 33/30 239/279
7,032,258 B2 * 4/2006 O'Hanlon ..... E04H 4/0012 4/487
7,309,302 B1 * 12/2007 Phillips ..... A63B 69/18 472/116
9,901,837 B2 * 2/2018 Henslee ..... A63G 31/007

* cited by examiner

*Primary Examiner* — Kien Nguyen
(74) *Attorney, Agent, or Firm* — Clement Cheng

(57) ABSTRACT

The post is preferably made in sections including a lower post section connected to a middle post section connected to an upper post section. A water conduit passes through the post or along the post to deliver water from the water outlet to the bucket. A pool is formed as an aboveground pool and preferably includes an inflatable ring at an upper edge of the pool. A pool cavity for retaining water is defined by the inflatable ring. The pool has a pool outlet connected to an outlet line. The outlet line delivers water to a water pump. The water pump delivers water to a pressurized water line. The pressurized water line is connected to a water conduit. The first arm and the second arm form a yoke that attach to sidewalls of the bucket.

7 Claims, 1 Drawing Sheet

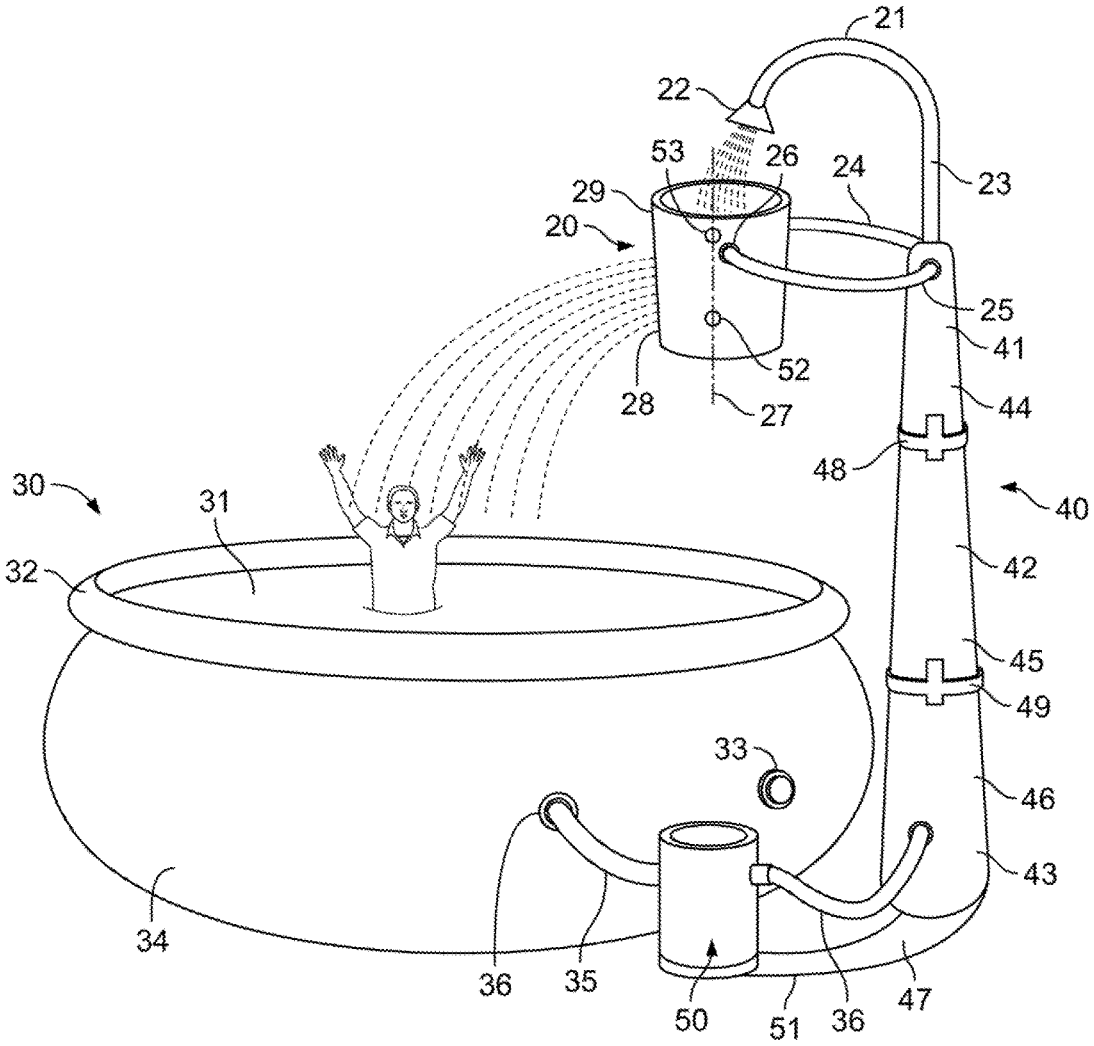
21
22
53
26
24
23
29
20
25
41
52
28
27
44
48
40
30
31
42
32
45
49
33
46
43
34
36
35
50
51
36
47

BUCKET SPLASH DUMPER

FIELD OF THE INVENTION

The present invention is in the field of evaporative cooling.

DISCUSSION OF RELATED ART

A variety of evaporative cooling apparatus have been created for summertime backyard fun.

SUMMARY OF THE INVENTION

The post is preferably made in sections including a lower post section connected to a middle post section connected to an upper post section. A water conduit passes through the post or along the post to deliver water from the water outlet to the bucket. A pool is formed as an aboveground pool and preferably includes an inflatable ring at an upper edge of the pool. A pool cavity for retaining water is defined by the inflatable ring. The pool has a pool outlet connected to an outlet line. The outlet line delivers water to a water pump. The water pump delivers water to a pressurized water line. The pressurized water line is connected to a water conduit. The first arm and the second arm form a yoke that attach to sidewalls of the bucket. The post sections include plastic stand sections for retaining a water conduit to the plastic stand sections. The base attachment is mounted to a lower portion of the post. The base attachment has a pair of base feet extensions that extend from the base attachment. The base feet extensions are configured to fit underneath the pool, wherein the base feet extensions stabilize the post.

BRIEF DESCRIPTION OF THE DRAWINGS

FIG. 1 is a diagram of the present invention.

The following call out list of elements can be a useful guide in referencing the element numbers of the drawings.

20 Bucket
21 Water Outlet
22 Outlet Spray Head
23 Water Conduit
24 First Arm
25 Second Arm
26 Bucket Pivot
27 Travel Line Of The Center Of Gravity
28 Sloped Sidewall
29 Inverted Conical Shape
30 Pool
31 Pool Cavity
32 Inflatable Ring
33 Pool Inlet
34 Pool Sidewall
35 Outlet Line
36 Pressurized Water Line
40 Post
41 Upper Post Section
42 Middle Post Section
43 Lower Post Section
44 Upper Plastic Stand Section
45 Middle Plastic Stand Section
46 Lower Plastic Stand Section
47 Base Attachment
48 Upper Connector
49 Lower Connector
50 Water Pump

51 Base Feet Prong
52 Initial Center Of Gravity
53 Dumping Center Of Gravity

DETAILED DESCRIPTION OF THE PREFERRED EMBODIMENT

The present invention includes a water outlet 21 that sprays water into a bucket 20. The bucket has a generally inverted conical shape 29 with sloped sidewalls 28. A vertical line through the center of gravity shows a travel line of the center of gravity 27 of the bucket as the bucket is filled with water. The center of gravity is not directly above or below the bucket pivot. The bucket therefore tips when filled with water. When low on water, the bucket pivot 26 is above the center of gravity. However, when the bucket is filled with water, the center of gravity rises above the bucket pivot 26.

A first center of gravity is the initial center of gravity 52. A second center of gravity is a dumping center of gravity 53 where the bucket dumps water into the pool 30. The center of gravity travels upward along the vertical line of center of gravity through the center of gravity along the travel line of the center of gravity 27. The center of gravity starts from the initial center of gravity 52 and travels to the dumping center of gravity 53 as the water outlet 21 sprays water from the outlet spray head 22 into the bucket 20.

The bucket has a bucket pivot 26 where the bucket is pivotally mounted on a first arm 24 and a second arm 25. The first arm 24 and the second arm 25 form a wishbone connection that attaches to sidewalls of the bucket. The first arm and the second arm connect to the upper post section 41. The upper post section 41 has a water conduit 23 extending from an upper end of the upper post section 41. The water conduit can be formed as a tube such as a pipe for carrying water up to the water outlet 21. The first arm and the second arm can be formed as middle tubular members.

The post 40 can be made of sections. The upper post section 41 is preferably connected to a middle post section 42 which is connected to a lower post section 43. The upper post section 41 can be formed from an upper plastic stand section 44 having an upper connector 48. The upper connector 48 can connect the upper plastic stand section 44 to the middle plastic stand section 45. The middle plastic stand section 45 connects to the lower plastic stand section 46 at the lower connector 49. The plastic stand sections can be made of injection blow molded or rotary molded posts. The plastic stand sections can be reinforced with the water conduit 23 that extends vertically from the upper portion of the upper post section 44 down to the lower post section 43. The plastic stand sections are preferably supported at a base attachment 47. The base attachment 47 preferably has a pair of base feet prong 51 that extend from the base attachment 47.

A pool 30 can have an inflatable ring 32 that defines a pool cavity 31 for receiving water from the bucket 20 when the bucket 20 rotates to overturn and dump water contents into the pool 30. The poor 30 also preferably has a pool sidewall 34. The pool sidewall 34 is preferably formed with a pool inlet 33 which is formed as a port for receiving water from a hose for example. Additionally, the pool sidewall 34 can be provided with a pool outlet valve 36. The pool outlet valve 36 can be threaded for receiving and outlet line 35. The outlet line 35 is preferably a hose that connects the pool sidewall 34 to the water pump 50. The water pump 50 preferably has a motor that is electric for pressurizing and output of water into a pressurized water line 36. The pressurized water line 36 connects to the water conduit 23 inside the lower plastic stand section 46.

A variety of different connectors can be used for connecting the water conduit 23 to the post sections. The bucket therefore dumps in a periodic cyclical manner, defined by the time necessary for filling the bucket. After the bucket dumps each time, the bucket loses water and could be empty or at least partially empty. The bucket fills up with water again.

A bucket splash dumper includes a bucket suspended from a post. The post includes a water conduit. The bucket is mounted to the bucket pivot. The bucket pivot is held by a pair of arms, namely a first arm and a second arm. The first arm and the second arm are connected to the post. The bucket has an empty state and a tipping state. An initial center of gravity of the bucket is defined at a location when the bucket is empty. Later, a dumping center of gravity of the bucket defines when the bucket is tipping. The dumping center of gravity of the bucket is higher than the initial center of gravity. A water outlet is configured to spray water into the bucket. The bucket begins at the empty state and is filled with water until the bucket is at the tipping state.

A travel line for a center of gravity of the bucket defines the travel of the center of gravity as the bucket fills up with water. As the bucket is filled with the water, the center of gravity rises along the travel line. A base attachment can be mounted to the post. The base attachment has a base foot extending from the base attachment. The base foot extends away from the post.

The invention claimed is:

1. A bucket splash dumper comprising:

a. a bucket suspended from a post, wherein the post includes a water conduit;

b. a bucket pivot, wherein the bucket is mounted to the bucket pivot, wherein the bucket pivot is held by a pair of arms, namely a first arm and a second arm, wherein the first arm and the second arm are connected to the post, wherein the bucket has an empty state and a tipping state;

c. an initial center of gravity of the bucket when the bucket is empty;

d. a dumping center of gravity of the bucket when the bucket is tipping, wherein the dumping center of gravity of the bucket is higher than the initial center of gravity;

e. a water outlet configured to spray water into the bucket, wherein the bucket begins at the empty state and is filled with water until the bucket is at the tipping state;

f. a travel line for a center of gravity of the bucket, wherein as the bucket is filled with the water, the center of gravity rises; and g. a pool, wherein the pool has an inflatable ring at an upper edge of the pool and a pool cavity defined by the inflatable ring, wherein the pool has a pool outlet connected to an outlet line, wherein the outlet line delivers water to a water pump, wherein the water pump delivers water to a pressurized water line, wherein the pressurized water line is connected to the water conduit.

2. The bucket splash dumper of claim 1, further including: a base attachment mounted to the post, wherein the base attachment has a base foot extending from the base attachment, wherein the base foot extends away from the post.

3. The bucket splash dumper of claim 1, wherein the post is made in sections including a lower post section connected to a middle post section connected to an upper post section, wherein a water conduit passes through the post to deliver water from the water outlet to the bucket.

4. The bucket splash dumper of claim 1, wherein the first arm and the second arm form a yoke that attach to sidewalls of the bucket.

5. The bucket splash dumper of claim 1, wherein post sections include plastic stand sections for retaining a water conduit to the plastic stand sections.

6. The bucket splash dumper of claim 1, further including a base attachment mounted to a lower portion of the post, wherein the base attachment has a pair of base feet extensions that extend from the base attachment.

7. The bucket splash dumper of claim 1, wherein base feet extensions are configured to fit underneath the pool, wherein the base feet extensions stabilize the post.

* * * * *